United States Patent [19]

Suzuki et al.

[11] 4,446,701

[45] May 8, 1984

[54] FLUID-OPERATED REFRIGERATING MACHINE

[75] Inventors: Mitsuru Suzuki; Yasuo Tomita, both of Hiratsuka, Japan

[73] Assignee: Sumitomo Heavy Industries, Ltd., Tokyo, Japan

[21] Appl. No.: 417,351

[22] Filed: Sep. 13, 1982

[30] Foreign Application Priority Data

Sep. 14, 1981 [JP] Japan ..... 56-145295

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,564,363 | 8/1951 | Horowitz et al. | 62/6 |
| 2,966,035 | 12/1960 | Gifford | 62/6 |
| 3,188,819 | 6/1965 | Hogan | 62/6 |
| 3,625,015 | 12/1971 | Chellis | 62/6 |

*Primary Examiner*—Ronald C. Capossela

*Attorney, Agent, or Firm*—Armstrong, Nikaido, Marmelstein & Kubovcik

[57] ABSTRACT

A fluid-operated refrigerating machine for developing extremely low temperature by using a displacer reciprocatable within a refrigeration cylinder and a fluid-operated piston solidly connected to the displacer. A mechanical converter which converts a reciprocating motion into a rotary motion is operatively connected to the piston to limit the stroke of the piston thereby to prevent the displacer from its collision with the end walls of the refrigeration cylinder and ensure smooth operation of the displacer. For controlling gas to and from the refrigeration cylinder as well as to and from the driving chamber of the piston, a single rotary valve driven by a motor is used. In an embodiment, the rotary valve is operatively connected to the converter and thus the displacer is not only under fluid-operation but also is mechanically operated by the motor through the converter.

2 Claims, 3 Drawing Figures

FLUID-OPERATED REFRIGERATING MACHINE

BACKGROUND OF THE INVENTION

The present invention relates to a refrigerating machine for developing extremely low temperature through the expansion of compressed fluid and, more particularly, to a fluid-operated refrigerator in which the pressure of the refrigerant is used for driving a displacer.

This refrigerating machine is adapted to perform a refrigeration cycle, so-called Gifford-McMahon cycle disclosed in the specifications of U.S. Pat. Nos. 2,966,035 and 3,188,819. This refrigeration cycle offers various advantages because it is actually carried out as a no-work cycle in which the work achieved by the expansion of the refrigerant is taken out in the form of heat but not in the form of mechanical work.

On the other hand, however, this Gifford-McMahon cycle imposes the following problem when the same is performed by a fluid-operated refrigerating machine. Namely, in such a case, it is extremely difficult to control the reciprocating motion of the displacer which operates as a free piston, so that the displacer often collides with the upper or lower end of the cylinder to generate vibration and noise.

SUMMARY OF THE INVENTION

Accordingly, it is a primary object of the invention to overcome the above-described problem in the fluid-operated refrigerating machine adapted to perform the Gifford-McMahon cycle.

To this end, according to the invention, there is provided a fluid-operated refrigerating machine comprising: a refrigeration cylinder; a displacer adapted to reciprocate within the cylinder and defining in the cylinder a first chamber and at least one second chamber, the volumes of which are varied by the reciprocating motion of said displacer such that when the volume of the first chamber increases the volume of the second chamber decreases and vice versa; a driving cylinder axially aligned with the refrigeration cylinder; a piston solidly connected to the displacer and adapted to reciprocate within the driving cylinder to define a driving chamber variable in volume by the reciprocating motion of the piston; a fluid path connecting the first and second chambers; thermal storage means provided in the path; a supply conduit for supplying high-pressure fluid; an exhaust conduit for exhausting low-pressure fluid; a rotary valve driven by a motor to control fluid communication such that at its first position the supply conduit is communicated with the path while the exhaust conduit is communicated with the driving chamber and at its second position the supply conduit is communicated with the driving chamber while the exhaust conduit is communicated with the path; and a mechanical converter for restricting the stroke of the piston, the converter having a first member operatively connected to the piston for reciprocating with the piston, a second member rotating about an axis stationary with respect the driving cylinder and a third member interconnecting the first and second members for converting the reciprocating motion of the first member to the rotary motion of the second member.

According to this arrangement, it is possible to set the upper and lower stroke ends of the piston and, hence, the displacer at any desired positions by means of the mechanical converter, so that the undesirable collision of the displacer with the upper and lower ends of the cylinder of the refrigerating machine is avoided completely.

According to a preferred form of the invention, the second member of the mechanical converter is operatively connected to a rotary valve so that mechanical driving system can be applied simultaneously with the fluid driving system.

Preferably, the above-mentioned mechanical converter is composed of a Scotch yoke mechanism or, alternatively, a double eccentric disc mechanism.

Other objects, features and advantages of the invention will become clear from the following description of the preferred embodiment of the invention taken in conjunction with the accompanying drawings.

DESCRIPTION OF THE PREFERRED EMBODIMENTS

Figure 1:
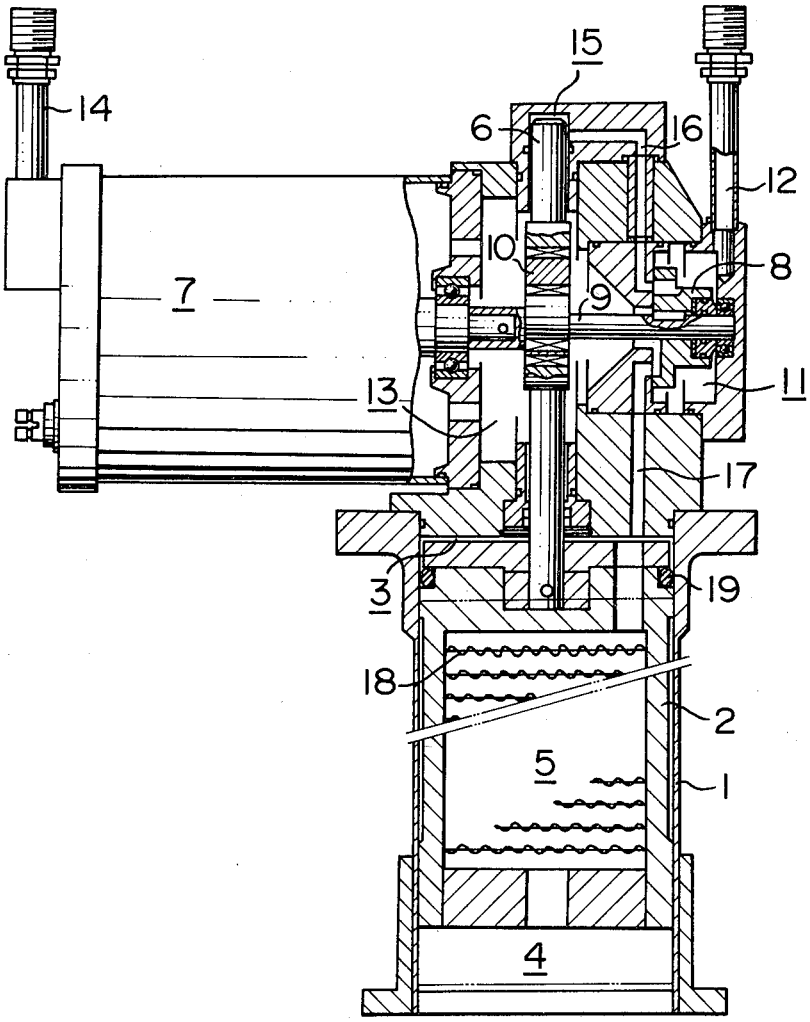
FIG. 1 is a vertical sectional view of a refrigerating machine in accordance with an embodiment of the invention.

Referring first to FIG. 1, a refrigerating machine of a first embodiment of the invention has a refrigeration cylinder 1 which reciprocatably receives a displacer 2. The displacer 2 defines an upper chamber 3 in the upper part of the cylinder and a lower chamber 4 in the lower part of the cylinder.

The displacer 2 is hollowed to define therein a cold accumulation chamber 5 which contains stacked copper screening 18. A driving piston 6 is connected to the upper end portion of the displacer 2 so as to extend upwardly therefrom.

A driving motor 7 is disposed above the cylinder 1 to rotatingly drive a rotary valve 8 while causing a reciprocating motion of the displacer 2. Namely, an eccentric shaft 9 is connected to the shaft of the driving motor 7, and the eccentric portion of this shaft 9 extends through the central portion of the driving piston 6. The eccentric portion is operatively connected to the driving piston 6 through a mechanical converter 10 for converting a rotary motion into a reciprocating motion, which consists of a double eccentric disc mechanism but may consist of a Scotch york mechanism. The aforementioned rotary valve 8 is connected to the end of the eccentric shaft 9.

A high-pressure gas chamber 11 in communication with a high-pressure gas supply conduit 12 is provided at the inlet side of the rotary valve 8, while a low-pressure gas chamber 13 is communication with a low-pressure gas exhaust conduit 14 is provided at the outlet side of the same. A driving cylinder is disposed above the refrigeration cylinder 1 and the end of the driving piston 6 is received in the driving cylinder to define therein a driving gas chamber 15. The chamber 15 is communicated with the rotary valve 8 through a passage 16. The rotary valve 8 is further communicated with the upper chamber 3 through a passage 17. Thus, the upper chamber 3 and the driving gas chamber 15 are brought into communication with the high-pressure gas chamber 11 and the low-pressure gas chamber 13, respectively, as the rotary valve 8 rotates.

In operation, as the driving motor 7 is started, the rotary valve 8 is rotated while the displacer 2 moves reciprocatingly.

Assuming here that the displacer 2 takes a position near the bottom dead center at which the volume of the lower chamber 4 is minimized while the volume of the upper chamber 3 is maximized, the high-pressure gas is introduced from the high-pressure gas chamber 11 into the upper chamber 3 through the passage 17 via the rotary valve 8 as the latter rotates. On the other hand, the gas in the driving gas chamber 15 is discharged to the low-pressure gas chamber 13 and then to the low-pressure gas exhaust conduit 14 through the passage 16 and the rotary valve 8.

Then, the displacer 2 is moved upwardly towards the top dead center so that the gas in the upper chamber 3 is displaced through the cold accumulation chamber 5 to the lower chamber 4 while being cooled by the cold accumulation chamber 5 as the gas flows through the latter. Since there is a difference of pressure receiving area between the upper and lower surfaces of the displacer 2 corresponding to the cross-sectional area of the driving piston 6, the displacer is subjected to an upward force proportional to the difference in the pressure-receiving area, so that the driving motor 7 can lift the displacer 2 with reduced torque.

When the displacer 2 reaches a position near the top dead center, the rotary valve 8 switches the path of flow so that the cylinder 1 is communicated with the low-pressure gas chamber 13 while the pressurized gas in the lower chamber 4 is displaced through the cold accumulation chamber 5 to the upper chamber 3 while making expansion. The gas is further exhausted to the low-pressure gas chamber 13 through the passage 17 and the rotary valve 8, so that the required refrigeration power is generated in the lower chamber 4 as a result of the expansion of the gas. In this state, since the driving gas chamber 15 is communicated with the high-pressure gas chamber 11, the driving piston 6 receives a downward force to provide the driving force for the next downward stroking of the displacer 2.

Figure 3:
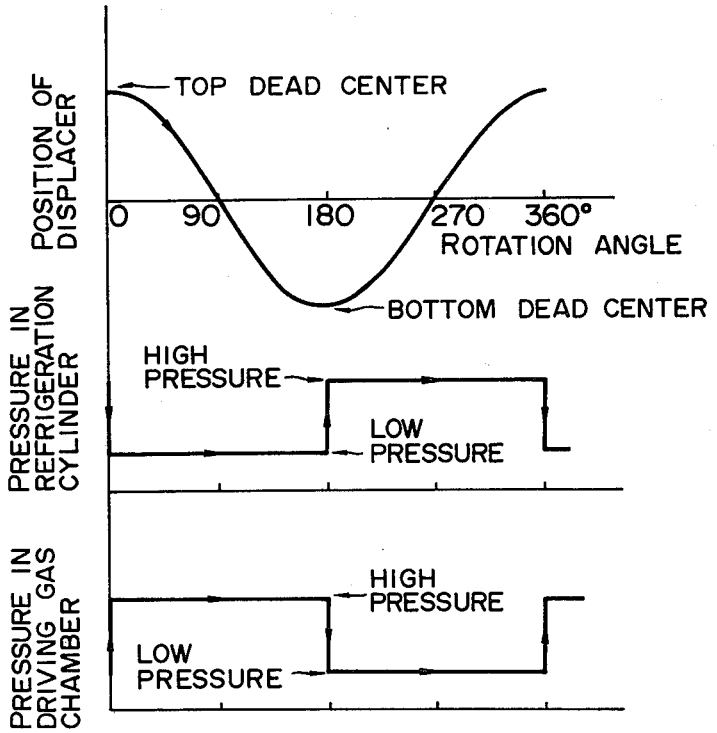
FIG. 3 is a graph showing the fundamental relationship between the pressure in the refrigeration cylinder and the pressure in the driving cylinder, in relation to the position of a displacer.

FIG. 3 shows the fundamental relationship between the pressure in the cylinder 1 and the pressure in the driving gas chamber 15 in relation to the position of the displacer 2. From this Figure, it will be seen that, as one of the high pressure and low pressure is established in the cylinder 1, the other pressure is established in driving gas chamber 15, so that the displacer 2 is subjected to a reciprocating driving force partly due to the pressure differential between the pressures acting on the displacer 2 and the driving piston 6, respectively. As a result, a remarkable reduction is achieved in the output torque of the driving motors required to mechanically drive the displacer 2 through the mechanical converter 10.

In addition, the switching of gas pressure in the cylinder 1 as well as in the driving gas chamber 15 between the high and low pressures is achieved by a single rotary valve advantageously.

In the machine of the mechanically operated type in which the displacer is driven by a motor alone through a rotation-reciprocation mechanical converter, the guide rod for guiding the reciprocation of the converter can be utilized as the driving piston 6, whereby it is possible to obtain a combined driving system, in which a mechanical driving system is combined with a gas driving system, simply by adding the passage 16.

Generally in the refrigerating machine performing the Gifford-McMahon cycle it is well known that in a transition period from the starting up to the regular operation of the machine the power required for driving the machine is varied from a minimum value to a maximum value, since in the transition period the lower chamber 4 and the cold accumulation chamber 5 are gradually cooled from a room temperature to a lowest temperature required for regular operation and correspondingly gas flow is gradually increased and the pressure drop of gas flowing through the cold accumulation chamber 5 is gradually increased so that the displacer 2 is subjected to gradually increased resistant force which is caused due to the difference between pressures acting on the upper and the lower ends of the displacer. For this reason, when the machine relies solely upon gas driving system, the tendency of the displacer colliding with the upper or lower end of the refrigeration cylinder 1 is enhanced in the transition period, since the driving piston which is designed to have the maximum power required for regular operation produces excess power for the transition period.

In the described embodiment of the invention relying upon the combined driving system in which the displacer 2 is driven not only by the piston 6 but also by the motor 7, the piston 6 is designed to have a driving power between the maximum and the minimum powers and the motor 7 is arranged to have an output power to compensate for a shortage of the piston power for the maximum power. This is advantageous in that a motor of a small size as compared with that in the machine of the mechanically operated type may be used and in that in the initial half of the transition period in which the driving power of the piston is excess, the motor acts to absorb the excess power so that smooth operation of the machine is ensured.

Moreover, in the gas-operated refrigerating machine performing the Gifford-McMahon cycle, the refrigerating performance is largely affected by the seal around the displacer. A higher seal around the displacer is obtainable by increasing the radially outward springing force imparted to a seal ring 19 around the displacer 2 but such a countermeasure is inevitably accompanied by an increase in the resistance against the sliding motion of the displacer to require a greater output torque of the driving motor. This problem, however, is completely overcome in the refrigerating machine according to the described embodiment of the invention relying upon combined driving system in which mechanical driving system and gas driving system are effectively combined.

Figure 2:
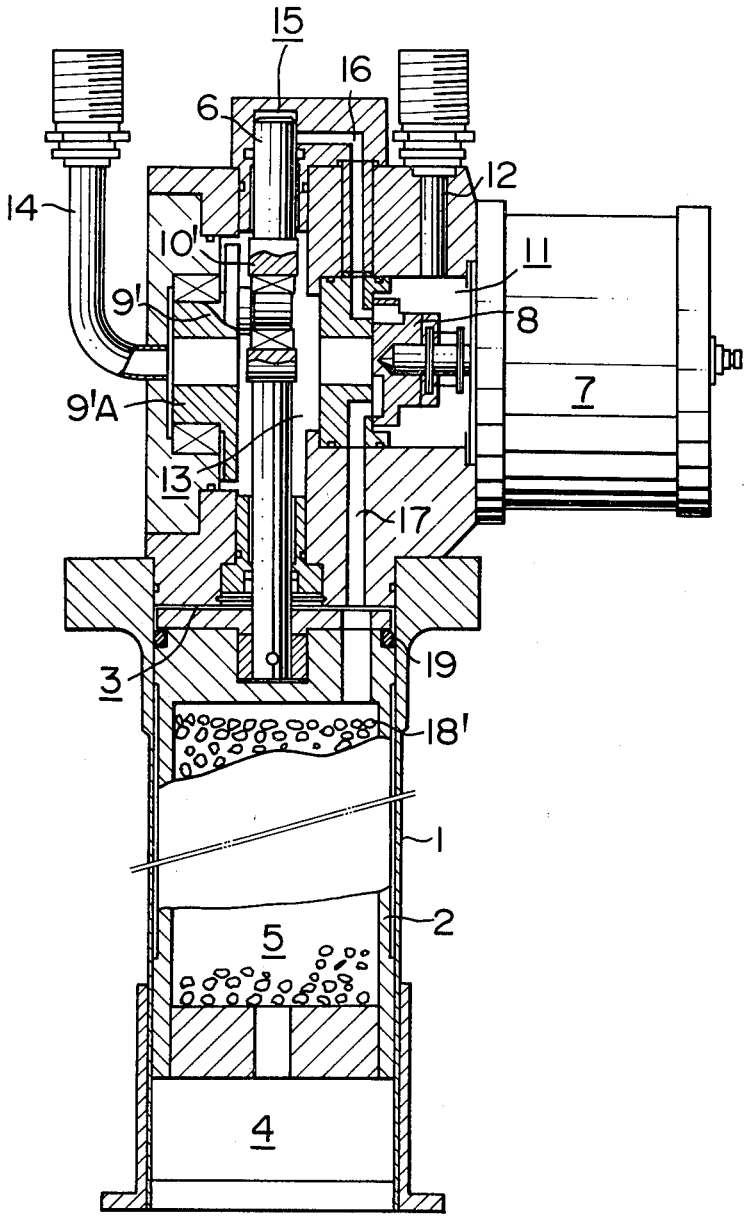
FIG. 2 is a vertical sectional view of a refrigerating machine in accordance with another embodiment of the invention.

FIG. 2 shows another embodiment of the invention in which the reciprocating drive of the displacer 2 is performed solely by the gas driving system. In this embodiment, the driving motor 7 is connected only to the rotary valve 8, and the mechanical converter 10' consisting of a Scotch yoke mechanism is provided with a follower eccentric shaft 9'. The mechanical converter may consist of a double eccentric disc mechanism. The cold accumulation chamber 5 is charged with small balls 18' of lead, bronze or the like material, although it may be charged with stacked copper screening 18 as in the case of the embodiment shown in FIG. 1.

The upper and lower stroke ends of the displacer 2 is limited by this eccentric shaft 9'. If necessary, the base portion 9'A of the eccentric shaft 9' is designed to have a function of a fly-wheel. By so doing, it is possible to achieve a smoother rotary motion.

In operation, as the rotary valve 8 is rotated, the displacer 2 is driven up and down reciprocatingly due to the difference in the pressure-receiving area between the upper and lower end surfaces of the displacer and the force acting on the driving poston, as in the case of the embodiment shown in FIG. 1. In this case, although the machine is of the completely gas-operated type, the displacer 2 is not a free piston but makes a smooth reciprocating motion of a constant stroke owing to the operation of the mechanical converter 10' and the eccentric shaft 9'.

As will be understood from the foregoing description, the fluid-operated refrigerating machine of the invention completely eliminates the collision of the displacer with the upper or lower end of the cylinder and, hence, any noise and vibration attributable to the collision. In addition, the control of reciprocating motion of the displacer is made much easier than in the known refrigerating machine of the type concerned.

Although the invention has been described through specific terms, it is to be noted here that the described embodiments are not exclusive and various changes and modifications may be imparted thereto without departing from the scope of the invention which is limited solely by the appended claims.

What is claimed is:

1. A fluid-operated refrigerating machine comprising:

a refrigeration cylinder;

a displacer adapted to reciprocate within said cylinder and defining in said cylinder a first chamber and at least one second chamber, the volumes of which are varied by the reciprocating motion of said displacer such that when the volume of said first chamber increases the volume of said second chamber decreases and vice versa;

a driving cylinder axially aligned with said refrigeration cylinder;

a piston solidly connected to said displacer and adapted to reciprocate within said driving cylinder to define a driving chamber variable in volume by the reciprocating motion of said piston;

a fluid path connecting said first and second chambers;

thermal storage means provided in said path;

a supply conduit for supplying high-pressure fluid;

an exhaust conduit for exhausting low-pressure fluid;

a rotary valve driven by a motor to control fluid communication such that at its first position said supply conduit is communicated with said path while said exhaust conduit is communicated with said driving chamber and at its second position said supply conduit is communicated with said driving chamber while said exhaust conduit is communicated with said path; and a mechanical converter for restricting the stroke of said piston, said converter having a first member operatively connected to said piston for reciprocating with said piston, a second member rotating about an axis stationary with respect said driving cylinder and a third member interconnecting said first and second members for converting the reciprocating motion of said first member to the rotary moion of said second member.

2. A fluid-operated refrigerating machine according to claim 1, wherein said second member of said converter is operatively connected to said rotary valve.

* * * * *